United States Patent [19]

Duza

[11] Patent Number: 4,815,303

[45] Date of Patent: Mar. 28, 1989

[54] VACUUM CRYOPUMP WITH IMPROVED FIRST STAGE

[76] Inventor: Peter J. Duza, 1576 Chambers Dr., San Jose, Calif. 95118

[21] Appl. No.: 171,100

[22] Filed: Mar. 21, 1988

[51] Int. Cl.[4] ..... B01D 8/00

[52] U.S. Cl. ..... 62/55.5; 55/269; 62/268; 417/901

[58] Field of Search ..... 62/55.5, 100, 268; 55/269; 417/901

[56] References Cited

U.S. PATENT DOCUMENTS

| | | | |
|---|---|---|---|
| 4,094,492 | 5/1978 | Beeman | 62/55.5 |
| 4,285,710 | 8/1981 | Welch | 62/55.5 |
| 4,438,632 | 3/1984 | Lessard et al. | 62/55.5 |
| 4,479,360 | 10/1984 | Bachler et al. | 62/55.5 |
| 4,531,372 | 7/1985 | Slabaugh | 62/55.5 |
| 4,611,467 | 9/1986 | Peterson | 62/55.5 |
| 4,614,093 | 9/1986 | Bachler et al. | 62/55.5 |

*Primary Examiner*—Ronald C. Capossela
*Attorney, Agent, or Firm*—Rosenblum, Parish & Bacigalupi

[57] ABSTRACT

A two stage cryopump with an improved first stage for condensing water vapor at high speed independently of the rate of gas flow into the second stage and without increasing the heat load on the cryopump. The cryopump utilizes a low profile high precision variable aperture to control flow to a lower baffle obstructing the mouth of a shroud containing the second stage, utilizes a support shaft mounted on the top of the lower baffle and extending upstream through the aperture, and utilizes an upper baffle mounted on the top of the shaft in thermal contact with the lower baffle to condense water vapor before reaching the aperture.

3 Claims, 3 Drawing Sheets

VACUUM CRYOPUMP WITH IMPROVED FIRST STAGE

BACKGROUND OF THE INVENTION

1. Field of the Invention

The present invention relates generally to vacuum pumping systems, and more particularly to a two stage cyropump with an improved first stage.

2. Discussion of the Prior Art

Several semiconductor fabrication processes such as thin film sputtering and etching are carried out in work chamber environments of mixtures of inert (e.g. argon) carrier gas and one or more process gas(es) at partial pressures which must be precisely controlled. Referring to FIG. 1, a work chamber 10 environment of specified gases is typically established by first using a mechanical vacuum pump 12 connected through pipe 13 to evacuate chamber 10 as much as possible, and then using source 14 of the specified gases to purge the chamber. Work chamber gas pressures may then be adjusted by exposure to and capture on chilled surfaces in a condenser or cryopump 20 which in effect pumps the condensed gases from the work chamber. A conventional cryopump 20 includes a housing 22 with walls 24 having inner surfaces 25 forming a vacuum envelope or cavity 26 with a top flange 27 around an opening 28 for fluid communication through a lid or base plate 29 and through conduit 30 to work chamber 10. Housing 22 has a floor 31 with a port 32 seated around an elongated "cold finger" or cooling means 34 which extends up from an external "cold head" 36. Cold finger 34 receives helium gas at room temperature and high pressure from a compressor (not shown) in a closed cycle gaseous helium refrigeration system. Cold finger 34 has first expansion cylinder 41 and smaller diameter telescoping second expansion cylinder 42 projecting into cavity 26 for expanding received helium gas to lower pressures and lower temperatures to chill cryopump surfaces to condense gases from the work chamber.

Work chamber residual water vapor commonly slows and limits the evacuation of the chamber and hinders carrying out various processes in the chamber. Many process gases are used at relatively low but critical pressures in the chamber, and will only condense at extremely low temperatures. To prevent water vapor from condensing, on and interfering with condensation of other gases on, surfaces needed at these lower temperatures, a conventional cryopump 20 uses a first stage 44 to condense water vapor and a second stage 46 to condense other gases. First stage 44 includes a shroud 48 supported solely by, and in thermal contact with, first stage expansion cylinder 41 of cold finger 34. Shroud 48 inside surfaces 50 form a compartment 51 surrounding the second stage expansion cylinder 42 and having a throat 52 which opens upwardly towards cavity opening 28. Compartment 51 contains panel, array or baffle means 54, which is thermally connected through couplings 56 and shroud 48 to first stage cylinder 41. Baffle 54 is typically formed by chevron shaped louvers 58 in an optically dense arrangement which blocks all possible lines of sight through baffle 54 and obstructs the compartment throat 52, obliging entering gas such as water vapor to wend around, and probably condense on, louver 58 surfaces chilled to between 77 and 90 degrees Kelvin, before being able to pass through and exit downwards into compartment 51 and second stage 46. First stage baffle 54 buffers or shield substantial thermal radiation from penetrating to second stage 46, but must allow uncondensed gases to have access to the inner second stage 46 of the cryopump.

Second stage 46 includes panel 60 supported on, and in thermal contact with, the distal end of second stage expansion cylinder 42, which chills panel 60 to about 18 degrees Kelvin to condense most remaining gases. Second stage 46 typically further includes an adsorbent bed 62 of charcoal granules or bonded sieve material to remove noncondensible gases such as hydrogen, helium, and neon.

The work chamber gas pressure can be controlled by a second stage 46 at a given temperature by controlling the second stage pressure by "throttling" the entering gas flow from work chamber 10. This has been done by "cranking" main valve 64 in conduit 30 upstream of cryopump 20, but throttling an upstream valve 64 also restricts the entry of water vapor, and hence reduces the water vapor pressure and condensation rate in the first stage 44 of cryopump 20.

U.S. Pat. No. 4,094,492 to Beeman describes a variable iris aperture used to control a flow of gas in a connecting conduit and thereby control the pressure in a differential vacuum (diffusion) pumping system (not shown). Before reaching the iris valve, water vapor is condensed in the conduit upstream by a liquid nitrogen cold trap. *Vacuum* Magazine, Vol. 34 No. 7 (1984), discloses a similar arrangement for a diffusion pumping system.

FIG. 2 illustrates schematically how in both U.S. Pat. No. 4,285,710 to Welch and U.S. Pat. No. 4,531,372 to Slabaugh the flow of gas into and pressure in a cryopump 70 second stage 46 is throttled by using a valve 72. The valve 72 body and vanes or rotor (not shown in detail) form an integral part of first stage 74, and, in all opening positions, expose a substantially constant surface area which is chilled to condense water vapor as a substitute for a conventional first stage condenser baffle 54. However, the valve 72 surface areas exposed are not actually constant and do not condense water at full speed independently of the valve positions. Such "constant" area valves do not dynamically and precisely control pressure over a wide range. These substitute first stage condenser valves 72 have mechanical support linkages 75 to pump housing 76, through which heat from the ambient surroundings is absorbed. Valves 72, through mounting blocks 77, are thermally connected to the first stage shroud 78. Valves 72 thereby constitute extra thermal loads and require extra refrigeration capacity for first stage 74 to condense water vapor. Welch provides a cryopump 70 with a liquid nitrogen reservoir (shown in dashed outline) to augment chilling first stage valve 72 and shroud 78. However, liquid nitrogen is undesireably expensive and inconvenient for condensing residual water vapor upstream of the second stage.

Thus, there is a need for a means for controlling the rate of gas flow into the second stage of cryopump while maintaining the efficiency and speed of condensing water vapor in the first stage of the cryopump.

SUMMARY OF THE PRESENT INVENTION

It is therefore a primary objective of the present invention to provide a two stage cryopump with means to control the rate of gas flow into the second stage and to maximize the rate of water vapor condensation in the first stage.

This and other objectives are achieved according to the present invention by providing a cryopump with a flow throttling valve mounted in thermal isolation from the pump stages and forming a variable diameter opening, and by providing an improved first stage. In addition to a conventionally mounted "lower" baffle, the first stage includes a thermally conductive support shaft mounted on the top of the lower baffle and projecting upwards through the valve opening, and an "upper" baffle supported on the top end of the shaft above the valve opening. The upper baffle is chilled through the support shaft by the lower baffle to condense water vapor from the entering stream of gas before it reaches the flow throttling valve.

Among the advantages of the present invention, one is that the first stage design can be optimized to maximize the rate of condensing water vapor. Another advantage is that the first stage pumps water at full speed without imposing an extra heat load on the cryopump refrigeration system.

DETAILED DESCRIPTION OF THE PREFERRED EMBODIMENT

Figure 1:
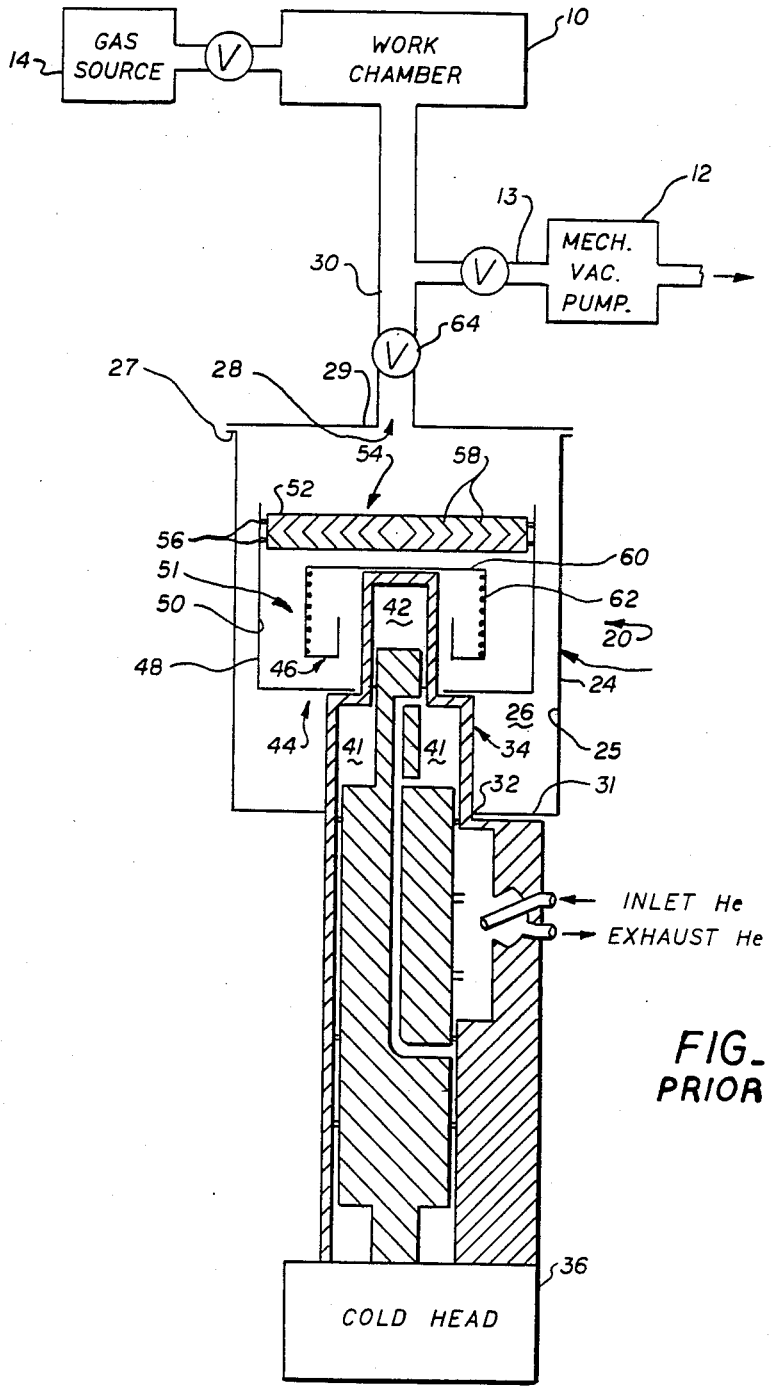
FIG. 1 PRIOR ART
FIG. 1 is a hybrid diagram of a vacuum process system showing in schematic block diagram form a vacuum work chamber, a process gas source, and a mechanical vacuum pump, and showing in cross-section a conventional two stage cryopump, cold finger and cold head.
Figure 3:
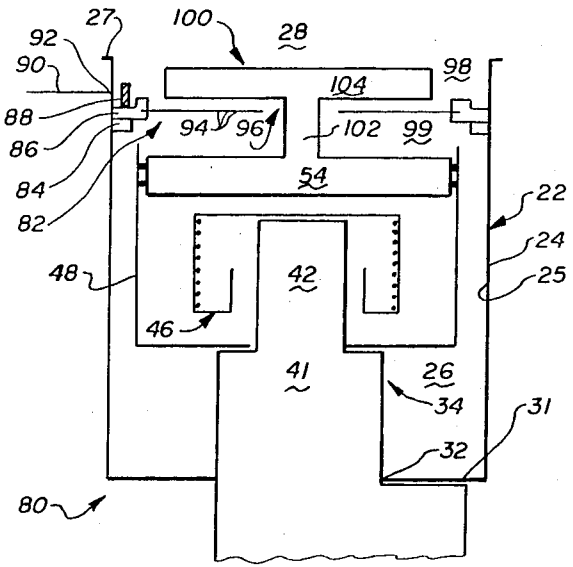
FIG. 3 is a cross-section through a cryopump with an improved first stage and throttling valve according to a preferred embodiment of the present invention.
Figure 2:
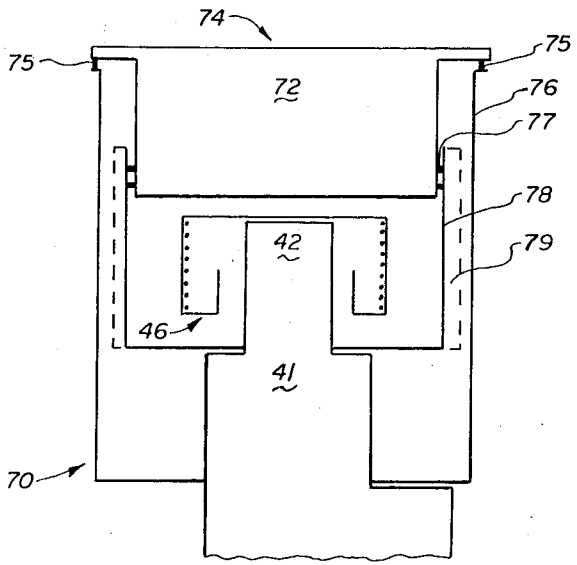
PRIOR ART FIG. 2
FIG. 2 is a cross-section showing in schematic form how two prior art cryopump structures use a flow throttling valve which is chilled to substitute for the conventional first stage baffle condenser.
Figure 4:
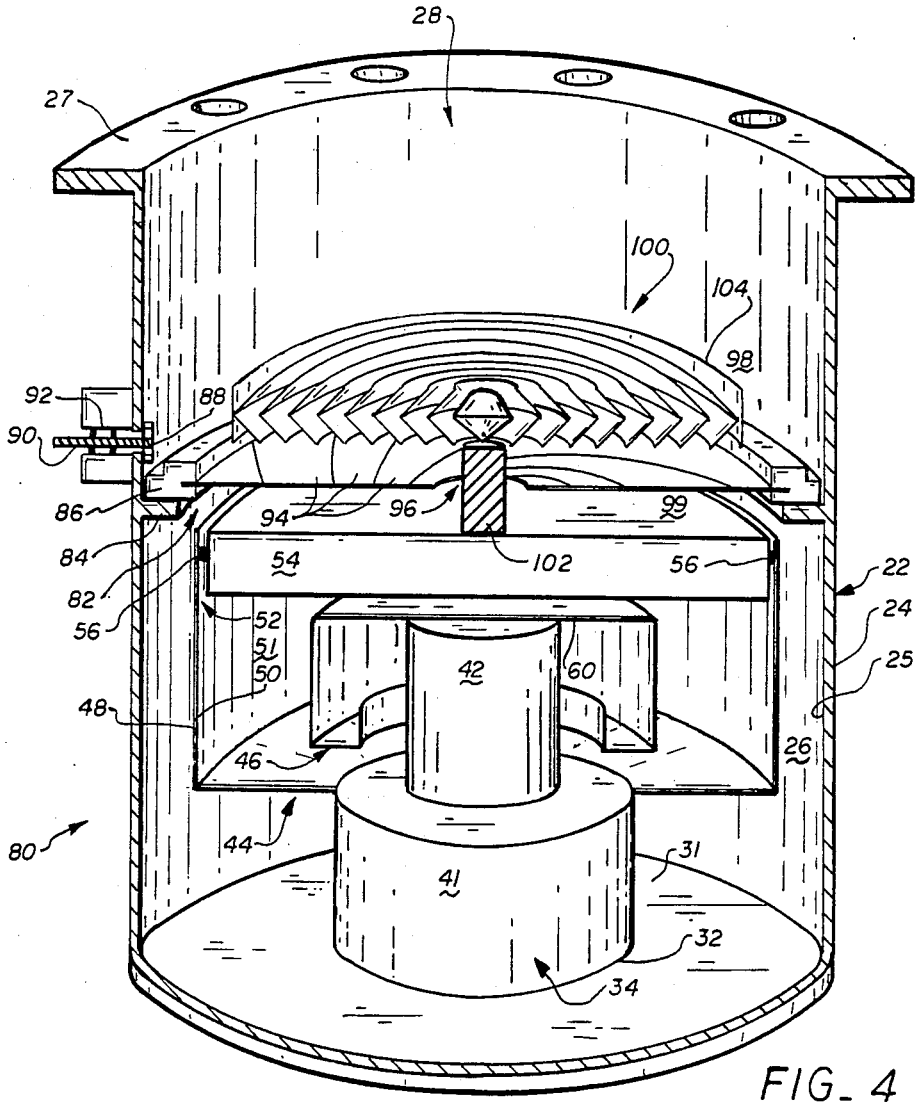
FIG. 4 is a partially broken away isometric view of the embodiment of FIG. 3.

Referring to FIGS. 3 and 4, the present invention in a preferred embodiment as cryopump 80 includes a housing 22, cold finger cooling menas 34, first stage shroud 48 and baffle 54, second stage 46 and other parts as shown, preferably corresponding to any like-numbered parts of cryopump 10 in FIG. 1. In accordance with the invention, cryopump 80 further includes a flow throttling valve 82, which is preferably an iris mechanism of the type described in U.S. Pat. No. 4,094,492 with a low vertical profile of approximately one and one half inches. Alternately, valve 82 may be another type of valve, for example a valve with rotating vanes as described in U.S. Pat. No. 4,531,372, although other types of valves do not have as low as profile and as precise control over flow pressure in as wide a range as the iris mechanism. Valve 82 may be mounted directly on, or through a support ring 84 which is attached to, inner wall 25 of housing 22, but in any case valve 82 is mechanically and thermally isolated from the chilled stages of the pump. Valve 82 remains at the ambient temperature of the housing 22 and does not increase the thermal load on the cryopump refrigeration system. Iris mechanism 82 includes a mounting ring 86 with a drive ring (not shown) turned by a drive gear 88 on a shaft 90 which passes through a sealed feedthrough hole 92 in the wall of housing 22, or through a hole (not shown) provided in the base plate 29 (FIG. 1). Mounting ring 86 holds moveable planar iris shutter leaves 94. Drive shaft 90 is turned to open and close leaves 94 to form a variable aperture 96 around the vertical centerline axis of housing 22. Shutter leaves 94 generally divide cavity 26 into an upper portion 98 above valve 82 and a lower portion 99 below valve 82.

Pump 80 has a split first stage 100 including lower baffle 54, a thermally conductive support shaft 102 which has a small diameter and is fixedly mounted, for example by welds or screw threads (not shown), onto the top of baffle 54 centered in the axis of housing 22 and projecting upwards through circular aperture 96, and including an upper baffle 104 which is fixedly mounted onto the top of shaft 102 above iris leaves 94. Shaft 102 provides a thermal connection from lower baffle 54 to chill upper baffle 104 to condense water vapor entering through opening 28. Only after the bulk of any residual water vapor has been removed by baffle 104 does the gas flow reach iris valve 82, which constricts gas flow pressure to control the pumping rate of the second stage.

Although the present invention has been described in a preferred embodiment, it will be appreciated by those skilled in the art that this embodiment may be modified without departing from the essence of the invention. It is therefore intended that the following claims be interpreted as covering any modifications falling within the true scope and spirit of the invention.

I claim:

1. A cryopump comprising:

housing means including walls having inner sides forming an interior cavity with a top opening, and with a port;

elongated cooling means extending through said port into said cavity and including first and second cooling cylinders;

first stage condenser means disposed within said cavity and including shroud means supported by said cooling means and having inside surfaces surrounding the distal end of said cooling means and having an upwardly opening throat, lower baffle means affixed to said shroud means and obstructing the throat thereof, said lower baffle means being thermally connected through said shroud means to said cooling means, a thermally conductive support shaft having a lower end mounted on the top of said lower baffle means and having an upper end extending towards said top opening, and upper baffle means mounted on said upper end in a position above said throat and below said top opening;

second stage condenser means disposed within said shroud means and in thermal contact with said cooling means; and throttle valve means mounted within said cavity in thermal isolation from said condenser means and from said cooling means, and dividing said cavity into an upper portion and a lower portion, said valve means forming a variable aperture between said upper and lower baffle means for controlling the rate of flow of gases between said upper and lower portions.

2. A cryopump as in claim 1 wherein said valve means comprises a variable iris mechanism.

3. In a two stage cryopump of the type comprising:

housing means including walls having inner sides forming an interior cavity with a top opening for connecting said cavity to a vacuum work chamber, and having a port;

elongated cooling means extending through said port into said cavity and including first and second stage cooling cylinders;

first stage condenser means disposed within said cavity and including shroud means supported by and in thermal contact with the first cooling cylinder and forming a compartment surrounding the second cooling cylinder and having an upwardly opening throat, and baffle means affixed to said shroud means and obstructing the throat thereof, said baffle means being thermally connected through said shroud means to said cooling means;

second stage condenser means disposed beneath said baffle means within said compartment and in thermal contact with the second cooling cylinder; and throttle valve means fixedly disposed with respect to said housing and forming a variable aperture for controlling the rate of flow of gases into said second stage condenser means; the improvement therewith characterized in that:

said first stage baffle means further comprises a thermally conductive shaft having a lower end mounted in thermal contact on the top of said baffle means and having an upper end extending through said aperture, and comprises upper baffle means mounted on the upper end of said shaft in thermal contact with the first said baffle means;

whereby said upper baffle means substantially condenses water vapor received through said top opening before the water vapor reaches said aperture, at a rate substantially independent of the size of said aperture, without substantially increasing the heat load on said cooling means.

* * * * *